United States Patent [19]

Halter

[11] Patent Number: 4,552,317

[45] Date of Patent: Nov. 12, 1985

[54] APPARATUS FOR COILING A SYNTHETIC RESIN FOIL WEB

[75] Inventor: Hartmut Halter, Ruppichteroth, Fed. Rep. of Germany

[73] Assignee: Reifenhauser GmbH & Co. Maschinenfabrik, Troisdorf, Fed. Rep. of Germany

[21] Appl. No.: 656,609

[22] Filed: Oct. 1, 1984

[30] Foreign Application Priority Data

Oct. 1, 1983 [DE] Fed. Rep. of Germany ..... 3335713

[51] Int. Cl.[4] ..... B65H 17/08; B65H 23/00

[52] U.S. Cl. ..... 242/65; 242/75.2

[58] Field of Search ..... 242/65, 66, 75.1, 75.2, 242/67.1 R, 67.2, 67.3 R, 67.4, 67.5

[56] References Cited

U.S. PATENT DOCUMENTS

| | | | |
|---|---|---|---|
| 3,291,412 | 12/1966 | Rockstrom et al. | 242/65 |
| 3,734,307 | 5/1973 | Degelleke et al. | 242/65 X |
| 4,150,797 | 4/1979 | Kataoka | 242/75.2 X |

FOREIGN PATENT DOCUMENTS 0017277 10/1980 European Pat. Off. .

*Primary Examiner*—John M. Jillions

*Attorney, Agent, or Firm*—Karl F. Ross; Herbert Dubno

[57] ABSTRACT

The weight components along a pair of support arms for a coil of a foil web provide inputs to a controller whose other input is from an angle detector measuring the inclination of said arms so that the controller can operate a control member such as a fluid cylinder to maintain a constant contact pressure between the coil and a contact drum applying the web to the coil.

5 Claims, 2 Drawing Figures

APPARATUS FOR COILING A SYNTHETIC RESIN FOIL WEB

FIELD OF THE INVENTION

My present invention relates to an apparatus for coiling a synthetic resin foil web and, more particularly, a foil which can be generated by a foil-blowing machine or the like.

BACKGROUND OF THE INVENTION

Elongate webs, for example webs of thermoplastic synthetic resin, and especially synthetic resin foils, are generally stored, marketed and handled in rolls or coils which may have lengths of hundreds of meters and, depending upon the thickness of the foil, corresponding diameters and mass.

The foil is usually made on a foil-blowing machine in which the extruded tubular strand of the synthetic resin material is blown and then cooled to form a tubular foil which can be supplied, slit or rolled without further modification after the blown foil has been flattened, e.g. between a pair of rollers.

The rolling of the foil is usually effected in a coiling portion of the apparatus by passing the foil over a driven drum (contact drum) which rotates the coil as the web is wound up thereon. The web can be wound on mandrels which can be lifted from the coiling machine to deliver it to bag-making machinery or the like.

A conventional apparatus which winds continuous webs into a series of coils has been described in published European patent application No. 0 017 177 published Oct. 15, 1980. In this device, a sensor is provided for the pressure with which the coil bears against the contact drum. The sensor is a force-sensing device on the contact drum assembly which responds to the pressure applied to the contact drum and which is then utilized to control, via a fluid cylinder, a mechanism which regulates the force with which the coil presses on this drum, the coil and the mandrel upon which it is wound being supported by a pair of swingable arms so that the coil can press against the feed drum.

The problem with this system is the insufficient precision of the pressure control. The sensor registers not only the pressing forces but all kinds of perturbations which result from the drive of the contact drum. These include vibrations, torque fluctuations and the like. The irregularities in the coil or roll, unevenness in the foil which passes between the drum and the coil as it is wound onto the coil, and the like, provide both periodic and aperiodic disturbances in the force measurement.

While a filtering of periodic disturbances might, at first blush, be a practical solution to the lack of precision, in practice it is found that the periodic fluctuations are not predictable and, in any event, such filtration cannot eliminate the fluctuations resulting from aperiodic phenomena.

As a consequence, the device may respond erroneously or may so provide pressure control that the actual force with which the coil bears against the contact drum may vary with greater fluctuations than might be the case in the absence of the control. As a consequence, it may be necessary to provide additional control means to lift the coil away from the contact drum and for driving the coil independently of the contact drum to prevent any retardation of coiling which may result in a backing up of the web fed to the coil. Additional controls of this type are complex and introduce additional maintenance and cost factors.

In practice, therefore, the earlier system has not found application.

OBJECTS OF THE INVENTION

The principle object of the present invention is to provide an apparatus for the winding or coiling of foil webs whereby the disadvantages outlined above can be obviated.

A more specific object of the invention is to provide an apparatus of this type which allows highly precise control of the pressing force.

Another object of this invention is to provide an apparatus for the coiling of synthetic resin foils whereby the pressing force can be held constant with a high degree of precision.

SUMMARY OF THE INVENTION

These objects and others which will become apparent hereinafter are attained, in accordance with the present invention in a foil web-coiling machine which comprises, in the usual manner, a pair of swingable arms which are pivoted for swinging movement about a substantially horizontal axis at a lower end of these arms and which are provided at an upper end of each arm with a lodgment for the mandrel of a coil of the foil web to be wound up, means for controlling the swinging movement of these arms, hence for regulating the force which the coil can press against a contact drum, and a drive for the contact drum so that the web extends around a portion of the contact drum and then is wound on the coil where the coil presses against the contact drum with the aforementioned pressure or force which, according to the invention, is to be maintained constant.

According to the invention a force sensor is provided at at least one of these lodgments and preferably at each lodgment for measuring a force component in the longitudinal direction of the arm resulting from the weight of the coil. In addition, an angle sensor is provided for the angular position of the arm. From the knowledge of the angular position of the arm with reference to the location of the contact drum, and the force component along the arm resulting from the weight of the coil and the instantaneous pressing force, the instantaneous pressing force can be calculated by a control circuit and the output of the latter can be applied to the pressing control so as to maintain the pressing force constant.

Put otherwise, the invention comprises an electronic calculating circuit which receives as its inputs, an input representing the angular position of the arm and hence the diameter of the coil, and an input representing the force component in the direction of the arms so from these values the actual pressing force component can be calculated and has the output signal of this circuit utilized to control a fluid-operated mechanism which regulates the pressure applied by the coil to the contact drum.

The circuit can also have a display or register for the pressing force and/or weight of the roll or coil. The calculator need only provide the calculation in accordance with the predetermined trigonometric relationship between the force component along the arm as a function of the angle of this arm so that the pressing force can be controlled with great precision.

According to another feature of the invention, the control device can be programmed to output a signal representing the instantaneous value of the weight of the coil and/or a signal indicating a completed coil. In the past, measurements of the weight of the coil have required other means.

If the coil comprises a plurality of axially-spaced rolls formed from respective webs, from a knowledge of the width of the webs, the weights of the individual coils can be determined, and where different signals are obtained from the force sensors on the two arms, roll geometry defects may be ascertained and appropriate corrections can be made.

BRIEF DESCRIPTION OF THE DRAWING

The above and other objects, features and advantages of the present invention will become readily apparent from the following description, reference being made to the accompanying drawing in which.

SPECIFIC DESCRIPTION

Figure 1:
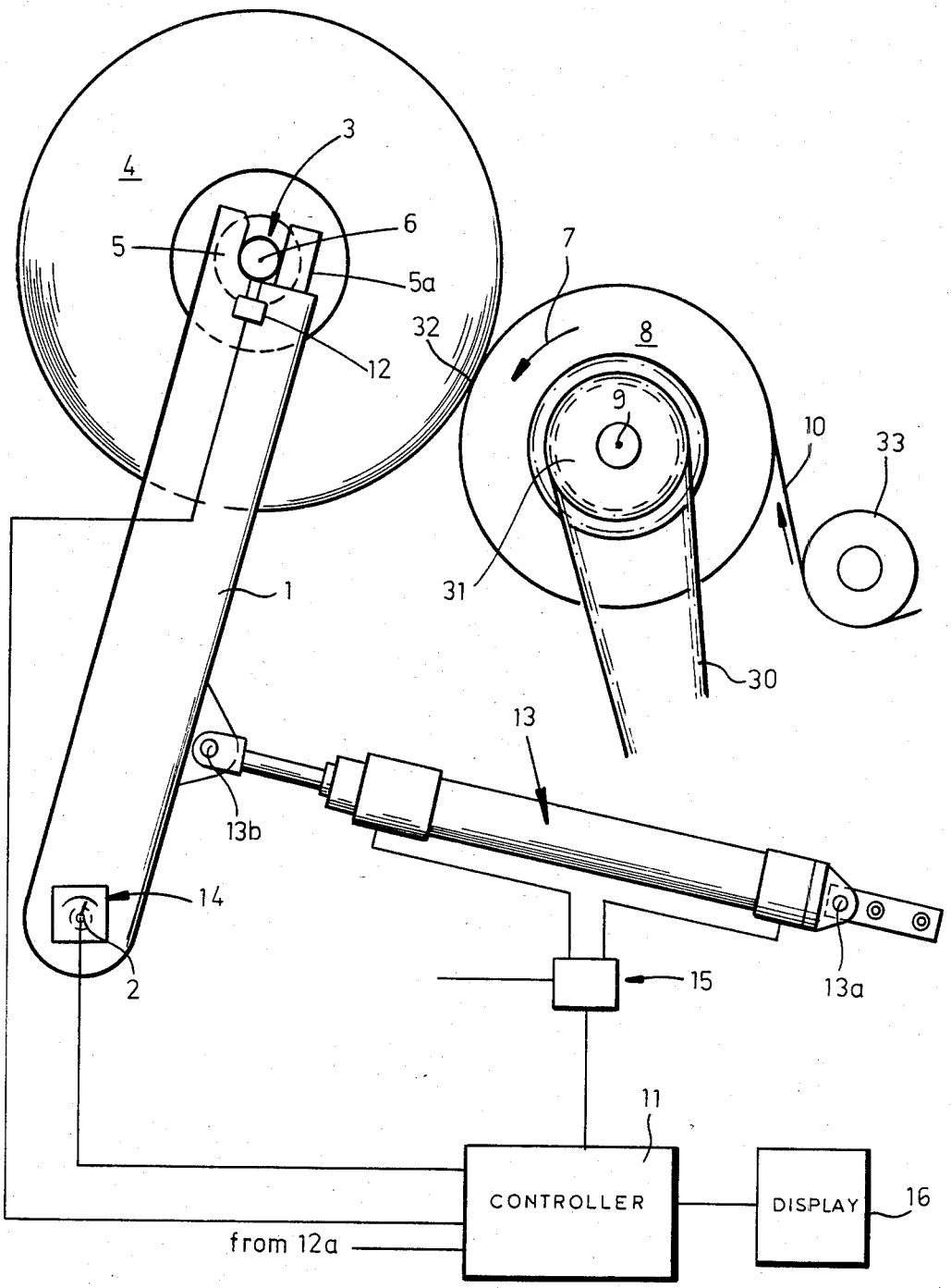
FIG. 1 is a diagram showing the coiling apparatus from the side and schematically illustrating the principles of the invention.
Figure 2:
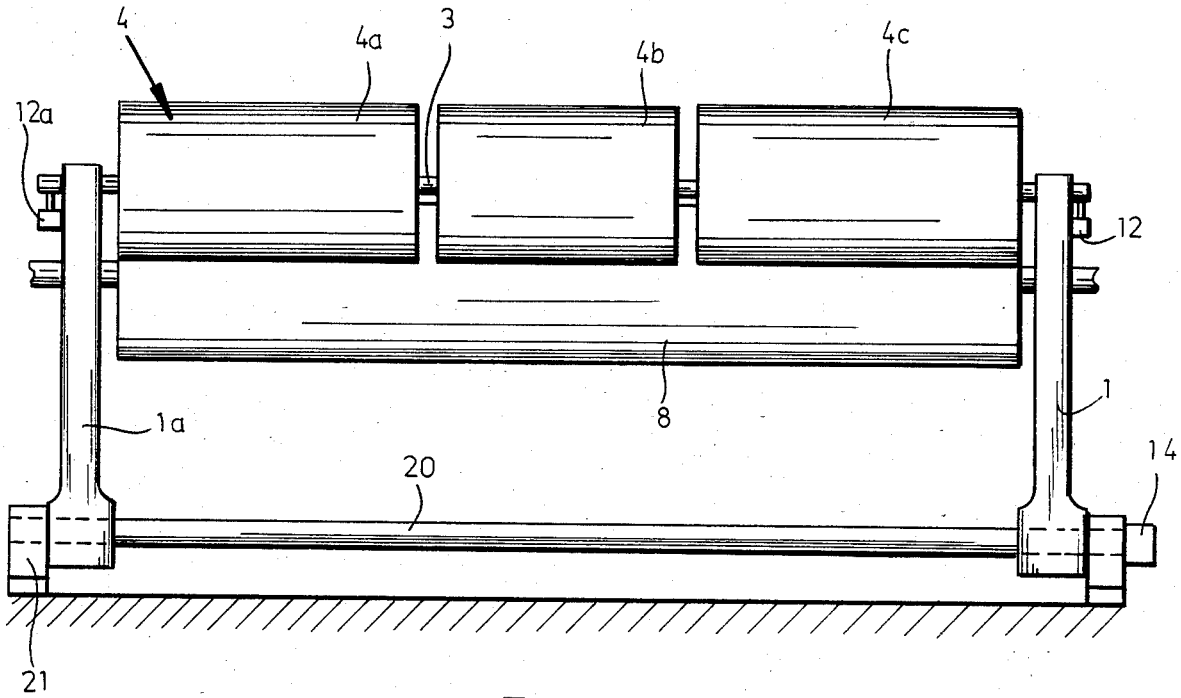
FIG. 2 is an elevational view from the rear of the device specific description.

The apparatus shown comprises a pair of mutually parallel swinging arms 1, 1*a* which can be journalled at their lower ends via a connecting shaft 20 on support trunnions or bearing blocks 21 so as to enable these arms to swing above the horizontal axis 2.

At the upper ends the arms 1, 1*a* are provided with respective lodgments 5 in which the opposite ends of the mandrel 3 can be received, the mandrel being rotatable about an axis 6 parallel to the axis 2. Means not shown in any detail and represented by a holder 5*a* can be provided to releasably retain the mandrel in the lodgments. A coil 4 of synthetic resin foil web 10, e.g. polyethylene foil, can be wound on this mandrel.

A contact drum 8 is rotated about a fixed axis 9 parallel to the axis 2 and 6 in the counterclockwise sense represented by the arrow 7 by a drive means represented by the drive belt 30 and the pulley 31. The foil web 10 passes over the contact drum 8 and is wound on the coil 4 at the point 32 at which this coil bears upon the contact drum with a pressure force which is intended to remain constant. The foil 10 can be fed from a foil-making or foil-blowing machine via a feeder or guide represented by the roller 33 onto the drum 8.

The apparatus also includes a controller 11 for maintaining constant the force with which the coil 4 bears upon the drum 8.

This control means includes a respective force sensor 12, 12*a* at each end of the mandrel 3 on the respective arms 1 and 1*a* of the swinging arm pair. A drive for controlling the swinging action of the arms has been represented at 13 in the form of a hydraulic piston and cylinder arrangement, the cylinder being pivoted at 13*a* to the housing or support of the apparatus while the piston is articulated at 13*b* to one of the arms 1.

The force measuring sensors 12 measure the force component applied by the coil 4 in the direction of the length of the respective arm to produce one input for a control circuit 11 which can compare the inputs from the two force sensors to alert the operator to an imbalance. When the force signal is to be utilized for calculating the pressure with which the coil 4 bears upon the drum 8, the force signal from the sensors 12 and 12*a* are added.

The other input to the control circuit derives from an angle detector 14 which senses the instantaneous value of the angle of the arms, the angle input and the force component input being combined in accordance with the predetermined trigonometric transfer function in the controller 11 to produce a signal operational to the actual pressing pressure and which is applied to the control valve 15 to maintain the actual pressing pressure constant. The controller 11 can include a display 16 which also can depict the instantaneous weight of the coil 4, likewise calculated in the controller 11 from the relevant angle and force measurements. Naturally, the display 16, when the arms are vertical, will display the summed signals of the force sensors to depict the weight of the finished coil. Any conventional circuitry preprogrammed for the appropriate trigonometric relationships can of course be used.

Specifically, the pressing force F can be defined as $F=W \tan \theta$ where W is the force component (sum of outputs of transducers 12 and 12*a*) in the direction of the arms and $\theta$ is the angular displacement of the arms from the vertical. When of course $\theta$ is zero, W represents the coil weight and F, the lateral pressure component is zero.

I claim:

1. An apparatus for coiling a coil web which comprises:

a pair of mutually parallel spaced apart arms pivotal about a horizontal axis at lower ends of said arms and having upper ends formed with lodgements adapted to support a coil formed by a foil web;

a contact drum adapted to apply said foil web to said coil;

drive means connected with said contact drum for rotating same and thereby rotating said coil, said coil bearing by its weight upon said contact drum;

a control member connected to at least one of said arms for regulating the pressure with which said coil bears on said drum;

at least one force sensor on said arms responsive to a force component of the weight of said coil parallel to said arms;

an angle sensor responsive to the inclination of said arms; and a controller receiving inputs from said sensors and connected to said member for controlling the pressure with which said coil bears against said drum.

2. The apparatus defined in claim 1, further comprising means for registering the instantaneous weight of the coil supported by said arms.

3. The apparatus defined in claim 1, further comprising means for signalling the attainment of a predetermined weight of said coil.

4. The apparatus defined in claim 1, further comprising means for signalling a completed weight of said coil.

5. The apparatus defined in claim 1 wherein said controller is provided with means for signalling the weight of said coil when said arms are in a vertical position.

* * * * *